United States Patent [19]

Hertelendy

[11] Patent Number: 4,673,233

[45] Date of Patent: Jun. 16, 1987

[54] WATERPROOF SPLICE CONNECTOR HAVING HIGH TENSILE PULLOUT RESISTANCE

[76] Inventor: Chris E. Hertelendy, 3364 Newburg Rd., Louisville, Ky. 40218

[21] Appl. No.: 912,211

[22] Filed: Sep. 25, 1986

Related U.S. Application Data

[63] Continuation of Ser. No. 801,461, Nov. 25, 1985, abandoned.

[51] Int. Cl.[4] ..... H01R 4/24

[52] U.S. Cl. ..... 439/442; 439/439; 439/440

[58] Field of Search ..... 339/97 R, 97 P, 98, 339/99 R, 95 D, 276 R, 276 T

[56] References Cited

U.S. PATENT DOCUMENTS

| | | | |
|---|---|---|---|
| 2,204,237 | 6/1940 | Slack et al. | 339/97 P |
| 2,291,434 | 7/1942 | Hollopeter et al. | 339/97 R |
| 2,753,392 | 7/1956 | Hebeler | 339/97 R |

*Primary Examiner*—Joseph H. McGlynn
*Attorney, Agent, or Firm*—John R. Benefiel

[57] ABSTRACT

A waterproof splice connector for pairs of electrical leads having a high tensile pullout resistance, suitable for use in splicing blasting cap leads, in which the each of the electrical leads are received in opposite ends of a respective one of a pair of clip connected tubular bodies, through holes formed in sealing end plugs. A tubular metal insert is disposed in each body and has oppositely directed roughly conical lead end receptacles, each formed with wire lead retaining barbs. The conical receptacles overlap such that the full length of the insert is utilized to grip a respective electrical lead. The sealing plugs are formed of a resilient material compressed into converging transition sections of the connector body to compress the plug ends and thereby close off the openings and sealingly grip a respective electrical lead. The interior of the connector is filled with an anti-oxidant sealant enhancing the water proofing of the connector interior.

8 Claims, 3 Drawing Figures

WATERPROOF SPLICE CONNECTOR HAVING HIGH TENSILE PULLOUT RESISTANCE

This application is a continuation of application Ser. No. 801,461, filed Nov. 25, 1985, now abandoned.

BACKGROUND OF THE INVENTION

The present invention is concerned with electrical connectors, and more particularly splice connectors for joining the ends of pairs of electrical leads to provide a waterproof connection able to resist significant tensile loads.

In conducting blasting operations for mining, excavation, seismic testing and the like, electrically detonated blasting caps are utilized. In many situations, the blasting caps are placed adjacent to charges located in boreholes at relatively great depth, extending vertically into the earth.

In such blasting operations there are typically a large number of charges and blasting caps implaced which all must simultaneously be detonated, or the blast will not produce the desired result and a misfire of any charge requires in a very costly reboring of the boreholes and emplacement and wiring of new charges.

Typically, such boreholes are below the water table such as to be flooded, so that the electrical connections thereto must be waterproof.

The leads to the blasting caps are also subjected to significant tensile stresses due to the relatively great depths and rough handling incidental to such operations.

A suitable splice connector for making electrical connections to the blasting cap has not heretofore been provided, which will with sufficient reliability achieve a waterproof connection which is also able to withstand the tensile stresses placed on the spliced connection in handling. For these reasons, the practice has been to provide a large inventory of blasting caps having leads of various lengths to accommodate various borehole depths.

Accordingly, it is an object of the present invention to provide a electrical connector for making dual splice connections between electrical leads, which is waterproof and able to withstand significant tensile stress, to allow reliable connections to detonator cap leads of a single length.

It is a further object of the present invention to provide such splice connector which is simple, low in cost, and easily usable in the field.

SUMMARY OF THE INVENTION

These and other objects of the present invention which will become apparent upon a reading of the following specification and claims are achieved by an electrical connector comprised of a tubular body of electrically insulating material, mounting in its middle section a tubular metal insert positioned to receive electrical leads received through either end of the tubular body.

The tubular body in turn has expanded ends which receive sealing plugs of a resilient, electrically insulating material, each having a central opening receiving an electrical lead.

The sealing plugs are press fit into the expanded ends into a transition section of the body, which compresses the inside end of the sealing plug such as to close off the central opening to seal the interior of the connector and grip the electrical lead inserted therethrough.

The tubular insert carries conical receptacles which extending longitudinally through the insert interior and are oppositely facing. A series of reversely extending barbs formed into the receptacles grip an electrical lead inserted therein to resist pullout.

The tubular insert is of a crimpable material such as to enable crimping of the ends thereof through the tubular outer body to further secure the wire leads in the connector. The tubular body is of transparent material assist in making an inspection of an inserted lead to insure proper making of the connection.

The interior of the tubular body is also filled with an anti-oxidant grease to seal out moisture and prevent oxidation of the electrically conductive surfaces and further inhance reliability of the connection.

A snap fit retainer clip is also utilized to together mount pairs of the splice connectors side-by-side to form a dual lead connector.

DETAILED DESCRIPTION

In the following detailed description certain specific terminology will be employed for the sake of clarity and a particular embodiment described in accordance with the requirements of 35 USC 112, but it is to be understood that the same is not intended to be limiting and indeed should not be so construed inasmuch as the invention is capable of taking many forms and variations within the scope of the appended claims.

Figure 1:
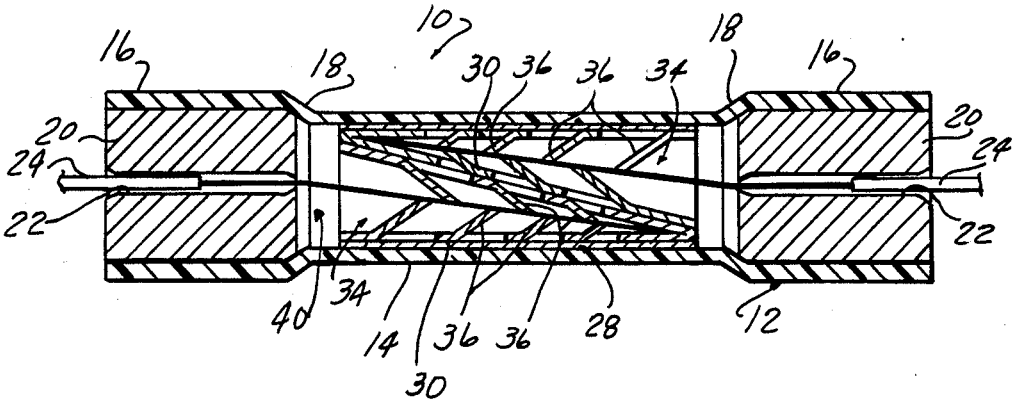
FIG. 1 is a view in longitudinal section of an electrical splice connector according to the present invention.

Referring to the drawings, and in particular FIG. 1, the electrical splice connector 10, according to the present invention includes a tubular body 12 of an electrically insulating material such as transparent plastic tubing.

Tubular body 12 includes a middle section 14 and a pair of expanded larger diameter ends 16 at either side with transitional sections 18 therebetween. Press fit into each expanded end 16 is a sealing plug 20 of a resilient electrically insulating material such as rubber or neoprene.

Each sealing plug 20 is formed with a relatively small diameter central opening 22 sized to receive an electrical lead shown at 24 allowing easy insertion by guiding the electrical lead thereinto. Each of the sealing plugs 20 is forced into the region of the transition section 18 such as to be compressed thereby, which in turn causes constriction of the openings 22. This constriction thus seals off the interior of the splice connector 10 prior to insertion of the electrical leads 24 and to grip the electrical leads 24 after insertion, to contribute to the retention forces acting on the wire and to seal around the wire electrical lead 24.

The constriction effect is further enhanced upon crimping of the electrical splice connector as will be hereinafter described in further detail.

Mounted within the middle section 14 of the tubular body 12 is a tubular insert of metal or other electrically conductive crimpable material such as copper or brass.

The tubular insert 28 is provided with a pair of oppositely facing roughly conical receptacles 34 also of a crimpable conductive material. Each receptacle 34 extends generally lengthwise along the tubular insert 28, but which is inclined to extend across the width of the tubular insert 28 as well, brazed or otherwise suitably secured therein.

The oppositely directed, overlapping receptacles 34 each have their open wider end facing a respective end of the connector, and are each in position to receive an electrical lead inserted through the respective sealing plug 20. Each receptacle 34 is wider at the receiving end and converges to terminate at a dead end to prevent an inserted lead 24 from passing through the interior of the splice connector 10.

A series of barbs 36 are stamped or otherwise formed into the walls 30 of the receptacle 34, the barbs reversely inclined as shown in FIG. 1 to the direction of withdrawal of the respective leads 24, such as to engage and grip the leads 24, resisting pull out.

Figure 2:
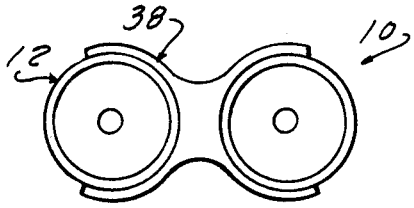
FIG. 2 is an endwise view of a pair of splice connectors according to the present invention, secured together by means of a retaining clip.
Figure 3:
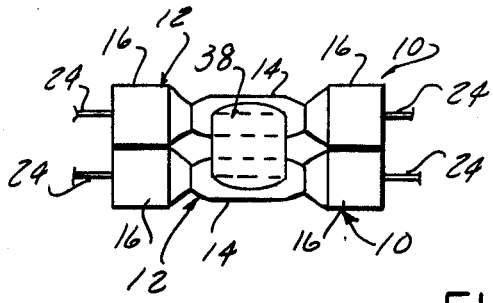
FIG. 3 is a plan view of a pair of crimped connectors connected by means of a snap fit retainer clip.

The splice connectors 10 are adapted to be connected in pairs as shown in FIG. 2 by a snap fit retainer 38 having oppositely directed C-shaped sides adapted to be snap fit around the central section 14 of the tubular body 12 of each connector 10.

In use, the electrical leads are inserted in opposite ends of the electrical connector through the respective sealing plugs 20 and into the respective receptacles 34 until bottoming in the dead end of the respective receptacle 34.

A simultaneous crimping operation is then preferably conducted on either of the ends of the metal tubular inserts 28 at the location of the transition sections 18. This causes a tight gripping of each of the wire connector by further compression of the sealing plug 20. Full length engagement of the barbs 36 and the tight engagement of the sealing plugs 20, with the leads 24 produces a high tensile strength connector.

The interior of each of the splice connector 10 is preferably filled with an anti-oxidant sealant such as a mass of silicone grease, indicated at 40, to preclude the entry of moisture and inhibit the oxidation of the electrically conductive surfaces to ensure reliability of a electrical connection made therebetween. Upon crimping of the electrical connector any excess sealant may be driven out past the electrical leads 24.

Accordingly, it can be appreciated that the electrical connector described produces a highly reliable electrical connection exhibiting waterproof and high tensile strength characteristics. Each of the electrical leads is able to be gripped along its full length of insertion, by virtue of the overlapping oppositely directed receptacles 34.

Engagement of the compressed sealing plugs 20 adds to the resistance to pull out of the electrical leads, as well as insuring a high degree of waterproofing as does the use of the anti-oxidant sealant.

At the same time, these splice connectors are convenient and simple to use, and are connected in pairs during the crimping operation such that dual leads normally employed in blasting cap applications are provided.

Accordingly, the splice connector according to the present invention suitable for such blasting cap applications to obviate the present requirement for a large inventory of blasting caps with various lead lengths.

I claim:

1. A splice connector for electrical leads comprising:

a tubular body of an electrically insulating material;

a sealing plug of a resilient, electrically insulating material mounted in each end of said tubular body having a central opening to receive an electrical lead;

a tubular insert mounted within said tubular body so as to receive electrical leads inserted through either end plug;

convergent oppositely directed conductive electrical lead receptacles and overlapping each other in said insert for receiving a respective electrical lead;

a plurality of barbs extending inwardly from said receptacle walls to grip and retain electrical leads inserted therein.

2. The splice connector according to claim 1 wherein said receptacles are mounted extending within said insert to be inclined across the width of said tubular insert.

3. The splice connector according to claim 1 wherein said tubular insert is formed of crimpable metal to enable crimping thereof at each end through said tubular body.

4. The splice connector according to claim 1 wherein said tubular body is of transparent plastic allowing visual inspection of an inserted electrical lead.

5. The splice connector according to claim 1 further including a clip able to be snap fit to a pair of tubular bodies of side-by-side connectors to enable securement together of a pair of splice connectors.

6. The splice connector according to claim 1 wherein said tubular body is formed with a transition section between a middle section and each of a larger diameter expanded end, each end receiving a respective sealing plug, and wherein each sealing plug is press fit thereinto and compressed into said transition section, said central opening and transition section sized so that insertion of said sealing plug closes off said central opening at one end of said sealing plug.

7. The splice connector according to claim 6 wherein the interior of said middle section of said tubular body and said tubular insert is filled with an anti-oxidant sealant.

8. The splice connector according to claim 7 wherein said sealant is silicon grease.

* * * * *